United States Patent [19]

Shizuya

[11] Patent Number: 4,759,287

[45] Date of Patent: Jul. 26, 1988

[54] UNIT-TO-UNIT REGISTER ADJUSTING APPARATUS FOR USE IN A SHEET-FED ROTARY PRINTING PRESS

[75] Inventor: Fumio Shizuya, Saitama, Japan

[73] Assignee: Komori Printing Machinery Co., Ltd., Japan

[21] Appl. No.: 586,889

[22] Filed: Mar. 9, 1984

Related U.S. Application Data

[63] Continuation of Ser. No. 385,186, Jun. 4, 1982, abandoned.

[30] Foreign Application Priority Data

Jun. 13, 1981 [JP] Japan ..... 56-91362

[51] Int. Cl.[4] ..... B41F 13/12; B41F 27/00; B41F 7/22

[52] U.S. Cl. ..... 101/248; 101/415.1

[58] Field of Search ..... 101/415.1, 378, 401.1, 101/DIG. 12, 248

[56] References Cited

U.S. PATENT DOCUMENTS

| | | | |
|---|---|---|---|
| 2,123,997 | 7/1938 | Jirousek | 101/415.1 |
| 2,775,198 | 12/1956 | Johnson et al. | 101/415.1 |
| 3,154,012 | 10/1964 | Fischer | 101/415.1 |
| 3,168,040 | 2/1965 | Norton | 101/415.1 |
| 3,835,778 | 9/1974 | Bock | 101/415.1 |
| 3,851,583 | 12/1974 | Norton | 101/415.1 |
| 3,858,512 | 1/1975 | Simeth | 101/415.1 |
| 3,884,147 | 5/1975 | Abendroth | 101/415.1 |
| 4,100,851 | 7/1978 | Jahn | 101/415.1 X |

*Primary Examiner*—J. Reed Fisher

*Attorney, Agent, or Firm*—Remy J. VanOphem

[57] ABSTRACT

A unit-to-unit register adjusting apparatus and method for multicolor printing presses includes a plate cylinder, a first plate clamping device on the leading side and a second plate clamping device on the trailing side for jointly clamping a plate on the plate cylinder. Each of the first and second plate clamping devices is disposed in an axial groove in the plate cylinder. The first plate clamping device is adjustably angularly movable by an adjustment bolt in the circumferential direction of the plate cylinder. The second plate clamping device is positionally adjustable by an adjustment bolt in the axial direction of the plate cylinder. By adjusting the first and second plate clamping devices in position on the plate cylinder, the plate can be positionally adjusted circumferentially and axially of the plate cylinder for complete registry with another plate on another plate cylinder. The adjustment bolts have graduations for allowing the operator to know an angular position thereof reliably through numerical confirmation.

14 Claims, 3 Drawing Sheets

UNIT-TO-UNIT REGISTER ADJUSTING APPARATUS FOR USE IN A SHEET-FED ROTARY PRINTING PRESS

This is a continuation of application Ser. No. 385,186, filed June 4, 1982, now abandoned.

BACKGROUND OF THE INVENTION

The present invention relates to a unit-to-unit register adjusting apparatus and method for adjustably bringing into mutual superimposition images printed by printing units for different colors in a multicolor sheet-fed rotary printing press.

Multicolor printing presses effect multicolor printing on a web at one position thereof or on a single sheet. Production of prints of good quality requires that the images printed by the successive printing units for different colors be brought into complete superimposition. To effect such an operation, each printing unit has a register adjusting apparatus for displacing a plate or a plate cylinder on which the plate is mounted in various directions. Register adjustment in the circumferential direction and the axial direction of the plate cylinder can be effected while the multicolor printing press is in operation by displacing the plate cylinder in the desired directions under remote control. With web-fed printing presses, skewing adjustment for correcting a plate out of circumferential displacement on a plate cylinder into proper lateral phase relation to the latter can also be carried out during operation of the printing press since register errors are relatively small and the plate cylinder can be skewed within a range in which the ball or roller bearings can be skewed.

However, sheet-fed rotary printing presses tend to suffer from relatively large register errors, and it is difficult to perform skewing adjustment while the press is being operated. A customary practice has been to stop the operation of the press, and then skew the plate into correct position relative to the plate cylinder. More specifically, the plate to be skewed into proper position is gripped at opposite ends by plate clamping devices disposed in a groove in a circumferential surface of the plate cylinder. The skewing of the plate for register adjustment is done by displacing the plate clamping devices with the plate gripped thereby with respect to the plate cylinder since there would be the danger of causing a skewing error if the plate clamping devices were loosened and tightened again to grip the plate. The skewing process is as follows: The plate clamping device on the leading side is properly affixed to the plate cylinder and grips the front end of the plate. The plate is wound around the plate cylinder and the rear end of the plate is gripped by the plate clamping device on the trailing side. The plate is completely mounted on the plate cylinder by pulling the trailing plate clamping device circumferentially of the plate cylinder. If the plate has been found to be improperly skewed with respect to the plate cylinder upon examination of the printed colors of a print, then the plate clamping device on the trailing side is loosened from the plate cylinder, the plate clamping devices on the leading and trailing sides are skewed back for required intervals, and the trailing plate clamping device is pulled in the circumferential direction of the plate cylinder, thus completing the skewing adjustment.

The foregoing procedure of skewing adjustment, however, is disadvantageous in that the positions in which the plate clamping devices are fixed and adjusted with respect to the plate cylinder differ dependent on the pitches of correction screws, and the actual amount of adjustment is liable to not be in agreement with the required amount of adjustment, which has been determined upon test printing. The prior skewing adjustment requires much skill on the part of the operator, is time-consuming as it needs repeated correction steps, and results in a large amount of spoilage or wasted printed material which is produced while the skewing adjustment is being made.

SUMMARY OF THE INVENTION

It is an object of the present invention to provide a unti-to-unit register adjusting apparatus and method for use in multicolor sheet-fed rotary printing presses, which allows the operator to effect register adjustment in various directions, including a skewing register adjustment between plate cylinders for different colors, in a reliable manner through numerical observation within a short period of time without requiring much skill.

Another object of the present invention is to provide a unit-to-unit register adjusting apparatus and method for use in multicolor sheet-fed rotary printing presses, which provides a standardized adjustment procedure, and brings the actual amount of adjustment into conformity with a required amount of adjustment through a single adjustment operation.

Still another object of the present invention is to provide a unit-to-unit register adjusting apparatus and method for improving the efficiency of operation and the quality of the printed product, and for reducing spoilage during register adjustment.

According to the apparatus and method of the present invention, a plate cylinder has a circumferential register adjusting mechanism and a lateral register adjusting mechanism. The plate cylinder further has, in a circumferential groove thereof, a pair of parallel plate clamping devices extending axially of the plate cylinder. One of the plate clamping devices is pivotably mounted at one end on the plate cylinder and has, at a distal end thereof, a graduated screw for displacing the plate clamping device circumferentially of the plate cylinder to position the plate clamping device. The other plate clamping device has a similar graduated screw for displacing the other plate clamping device axially of the plate cylinder to position the other plate clamping device. Both screws can be turned while their graduations are being observed to adjust the skewing of a plate on the plate cylinder for easy and correct register adjustment between plate cylinders for different colors.

The above and other objects, features and advantages of the present invention will become more apparent from the following description when read in conjunction with the accompanying drawings in which a preferred embodiment of the present invention is shown by way of illustrative example.

DESCRIPTION OF THE PREFERRED EMBODIMENT

Figure 1:
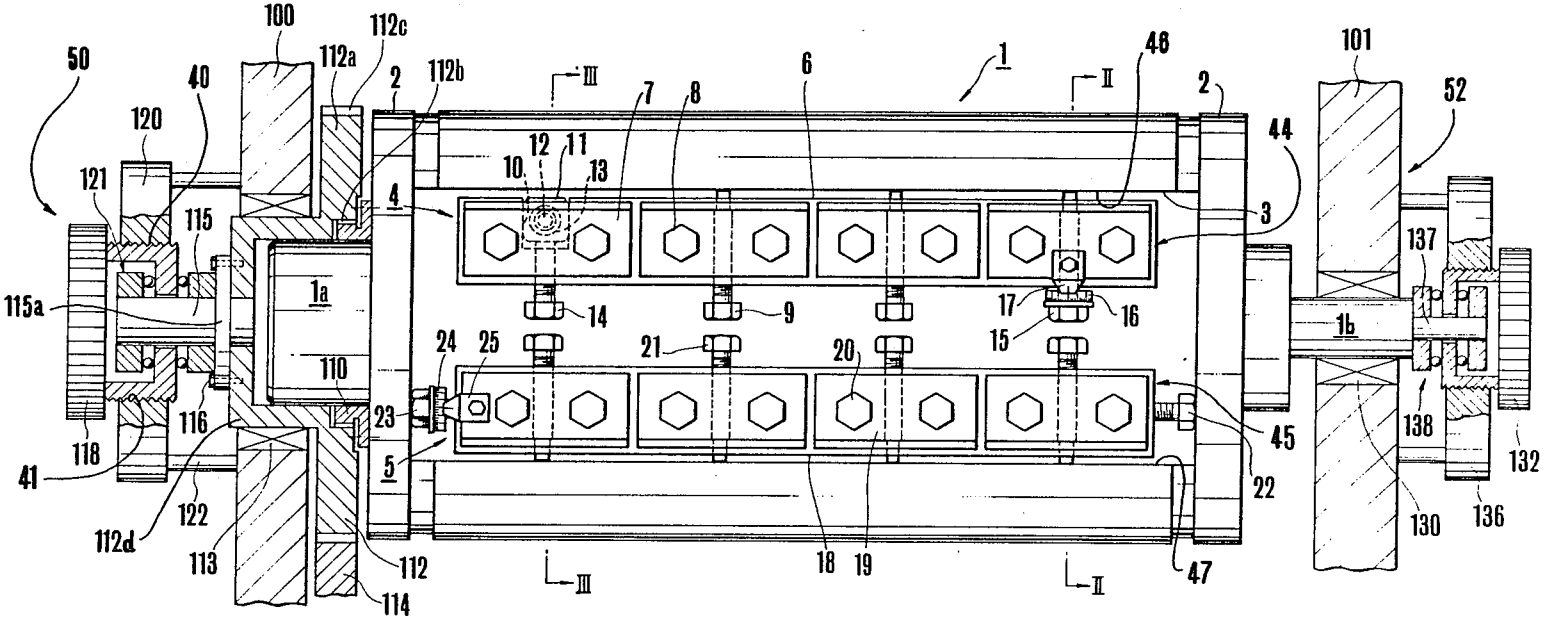
FIG. 1 is a plan view of a plate cylinder having a unit-to-unit register adjusting apparatus for a sheet-fed rotary printing press according to the present invention.

FIG. 1 shows plate cylinder 1 having opposite shaft ends 1*a* and 1*b* rotatably mounted on and extending axially between a pair of respective frames 100 101 of a printing unit the remainder of which is not shown. The plate cylinder 1 has at its shaft end 1*a* a circumferential register adjusting mechanism 50 of a known type for angularly moving the plate cylinder for a slight interval by displacing a driving helical gear member 112 axially, so that a relative phase displacement between adjacent plate cylinders for different colors can be changed for circumferential register adjustment.

More particularly, a spur gear 110 is interconnected with one of the shaft ends 1*a* of the plate cylinder 1 in the manner allowing the shaft end 1*a* to penetrate therein. The helical gear member 112 having an internal gear 112*b* is fitted over the shaft end 1*a* and the spur gear 110 and engages the spur gear 110. The helical gear member 112 is formed in a cup shape portion and has an outwardly oriented radial flange 112*a* and a bottom portion 112*d*. An external herical gear 112*c* is formed on the flange 112*a* and is, in turn, connected with a driving source (not shown) through a drive gear 114.

A stub shaft 115 having a flange 115*a* is interconnected with the top position 112*d* of the helical gear member 112 by means of a plurality of screws 116. The stub shaft 115 is provided with a handle 118 suitably connected thereto for hand adjustment of the plate cylinder 1, and external gear threads 40 engaging an internal thread 41 of a support member 120, and is further slidably connected with the bottom part of a cylinder member having a bottom, which is adapted to cause a thrust motion. Between the bottom part and the handle 118, there is provided a thrust bearing 121. The support member 120 is, in turn, supported by the frame 100 through a bracket 122. When the helical gear member 112 is moved in the axial direction by manually operating the handle 118, the plate cylinder 1 is angularly displaced by a slight interval, thereby adjusting the circumferential register.

The plate cylinder 1 also has at the shaft 1*b* a known lateral register adjusting mechanism 52 for slightly displacing the plate cylinder 1 in the axial direction by turning a screw. More particularly, the other shaft end 1*b* of the plate cylinder 1 is supported the frame 101 through a bearing 130. A stub shaft portion 137 is integrally formed with the other shaft end 1*b*. The stub shaft porition 137 engages, through appropriate threads, another support member member 136. The stub shaft portion 137 is slidably connected with the bottom part of another cylinder member having a bottom, which allows a thrust motion, a thrust bearing 138 being provided therebetween. Manual operation of a handle 132 causes slight displacement of the plate cylinder 1 in the axial direction thereof. The plate cylinder 1 is thus freely adjustable in position in the circumferential and lateral directions through mechanisms 50 and 52.

Figure 2:
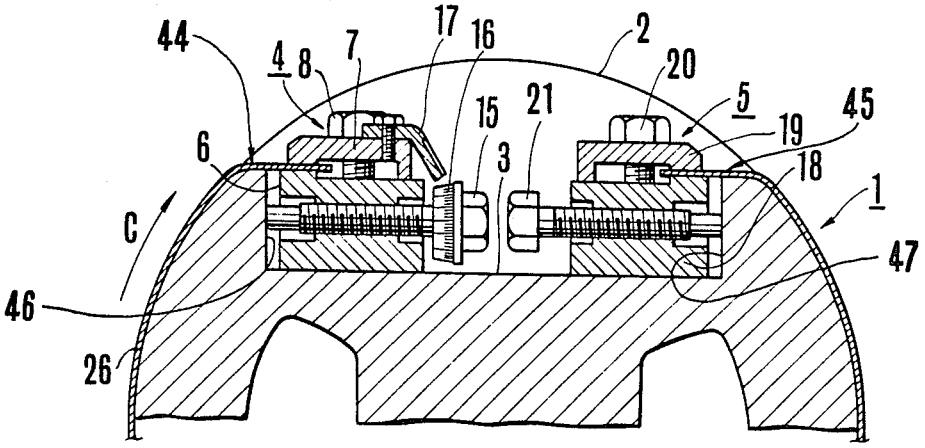
FIG. 2 is a cross-sectional view taken along line II—II of FIG. 1.
Figure 3:
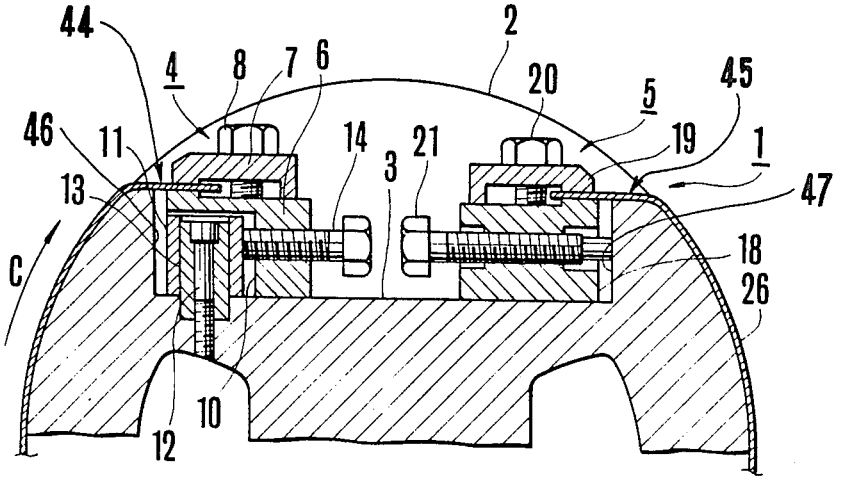
FIG. 3 is a cross-sectional view taken along line III—III of FIG. 1.

The plate cylinder 1 has in an outer circumferential surface thereof an axial groove 3 extending the full length of the plate cylinder 1 and closed off at its ends by a pair of disc-shaped walls or bearers 2. As shown in FIGS. 2 and 3, groove 3 has a circumferential leading slide 44 and a circumferential sides 45, the leading side 44 being positioned ahead of the trailing side 45 in the direction of rotation of the plate cylinder, shown by the arrow C.

The groove 3 has provided therein a plate clamping device 4 on the leading side 44, and a plate clamping device 5 on the trailing side 45. The plate clamping devices 4 and 5 extend parallel to each other substantially along the full length of the groove 3. The plate clamping device 4 on the leading side includes an elongated base 6 of a rectangular cross-section extending substantially along the full length of the groove 3 Four holder plates 7, which are of a smaller width than that of the base are 6 and of an L-shaped cross section, are mounted in juxtaposed relation on the base 6 and are fastened thereo by a plurality of crank bolts 8. Two adjustment bolts 9 extend threadedly laterally through the base 6 of the two middle holder plates 7 at positions parallel to each other at the approximate center of each base. The adjustment bolts 9 are threadedly movable toward and away from a wall surface 46 of the groove 3 through a turning movement. After the base 6 has been positioned in place, the adjustment bolts 9 are turned to bring their front ends into contact with the wall surface of the groove 3, thereby preventing the base 6 from being displaced toward the wall surface.

The base 6 has adjacent a first end thereof a substantially cube-shaped cavity 10, shown in FIGS. 1 and 3, which receives therein a cube-shaped support 11 having an integral bore rotatably fitted over a tubular pivot pin 13 fastened by a bolt 12 to a bottom of the groove 3. An adjustment bolt 14 is threaded laterally through the base 6 in alignment with the support 11. The adjustment bolt 14, upon turning movement, is movable toward and away from the tubular pivot pin 13. The plate clamping device 4 on the leading side 44 is thus angularly movable about the tubular pivot pin 13 to allow the second end of the plate clamping device 4 to move in the circumferential direction of the plate cylinder 1 relative to the first end thereof.

An adjustment bolt 15, shown in FIGS. 1 and 2 extends threadedly through the second end of the base 6 for positioning the second end of the base 6 in the circumferential direction of the plate cylinder 1. The adjustment bolt 15 is movable towards and away from the wall surface of the groove 3 when it is rotated about its own axis. The adjustment bolt 15 has a graduation ring 16 disposed adjacent to the head thereof. The adjustment bolt 15 cooperates with a pointer 17 screwed to the holder plate 7 on the second end of the base 6 to indicate an angular position of the adjustment bolt 15, and, thereby, a location in which the plate clamping device 4 is positioned.

The plate clamping device 5 on the trailing side is composed likewise of a base 18, which is of substantially the same shape and dimension as the base 6, and four holder plates 19 which are of substantially the same shape and dimension as those of the holder plates 7. The holder plates 19 are mounted on the base 18 and fastened to the latter by crank bolts 20. Four adjustment bolts 21 are threaded laterally through the base 18 at positions parallel to the centers of each of the holder plates 19, there being as many adjustment bolts 21 as holder plates 19. The adjustment bolts 21 are movable toward and away from a wall surface 47 of the groove 3 which is opposite to the wall surface 46 against which the adjustment bolts 9 and 15 are held.

A bolt 22, shown only in FIG. 1, extends threadedly into one longitudinal end of the base 18 and has a head held against an inner surface of the corresponding bearer 2. Likewise, an adjustment bolt 23 is longitudinally threaded into the other longitudinal end of the base 18 for positioning the plate clamping device 5 axially of the plate cylinder 1. The adjustment bolt 23 has a head held against an inner surface of the bearer 2 adjacent thereto. The adjustment bolt 23 has a graduation ring 24 adjacent to its head. The holder plate 19 supported on the other end of the base 18 has a pointer 25 screwed to the holder plate 19. The pointer 25 cooperates with the graduation ring 24 to indicate an angular position of the adjustment bolt 23, that is, a location in which the plate clamping device 5 is positioned.

A printing plate 26, which is in the form of a thin sheet of aluminum has substantially the same peripheral length and width as that of the plate cylinder 1. One end of the printing plate 26 is gripped between the base 6 and the holder plates 7 of the plate clamping device 4 The other end of the printing plate 26 is clamped between the base 18 and holder plates 19 of the plate clamping device 5. The remainder of the printing plate 26 is wound around the plate cylinder 1.

Operation of the unit-to-unit register adjusting apparatus thus constructed will now be described with reference to an application in which a second plate is to be registered with a first plate in a two-color printing press.

To mount each of the printing plates 26 on one of each of the two plate cylinders 1, the adjustment bolts 14 and 15 at the first and second ends of the plate clamping device 4 are turned so as to move back and forth until the base 6 is held parallel to the wall surface 46 of the groove 3. The crank bolts 8 are loosened to allow one or the leading end of the printing plate 26 to be inserted between the base 6 and the holder plates 7 at leading side 44. The crank bolts 8 are then fastened again to grip the inserted end of the printing plate 26. Thereafter, the printing plate 26 is wound around the plate cylinder 1, and the or trailing other end of the printing plate 26 is sandwiched between the base 18 and the holder plates 19 of the plate clamping device 5 at the trailing side 45. Then, all of the adjustment bolts 21 are tightened uniformly to pull the printing plate 26 into intimate contact with the peripheral surface of the plate cylinder 1. The bolt 22 and the adjustment bolt 23 are turned to compress the plate clamping device 5 to act in compression between the inner surfaces of the bearers 2 and 2, after the printing plate 26 has thus been mounted on each of the plate cylinders 1, register adjustment is carried out in the following manner:

Designated in each of FIGS. 4(*a*) through (*d*) at 31A is a plate cylinder for a first color, 31B a plate cylinder for a second color, 32A a plate for the first color, and 32B a plate for the second color, the figures being of developed views. The lower side of each of FIGS. 4(*a*) through 4(*d*) corresponds to the leading side 44, and the upper side 45 to the trailing side.

It is now assumed that it has been determined, as a result of test printing with the plates 32A and 32B mounted on the plate cylinders 31A, 31B, respectively, that the second plate 32B is displaced from the first plate 32A, which serves as a reference, by $S_1$ mm in the axial direction of the plate cylinders and by $C_1$ mm in the circumferential direction. The lateral register adjusting mechanism 52 is actuated to displace the second plate cylinder 31B by $S_1$ mm in the axial direction, and the circumferential register adjusting mechanism 50 is actuated to displace the second plate cylinder 31B toward the trailing side by $C_1$ mm along the circumferential surface. The second plate 32B is thereby moved from the position of FIG. 4(*a*) to the position of FIG. 4(*b*), in which the plates 32A and 32B have their one corners $P_1$ in conformity with each other on the leading side.

As a consequence, the second plate 32B is displaced from the first plate 32A by $S_2$ axially of the plate cylinders and by $C_2$ circumferentially thereof. The first adjustment operation is effected by moving the plate cylinder 31B. The subsequent or second register adjustment operation is carried out on the second plate 32B with the register adjusting apparatus according to the present invention.

The adjustment bolts 21 on the plate clamping device 5 on the trailing side 45 are loosened to release the plate 32B partly, and then the adjustment bolt 15 on the plate clamping device 4 on the leading side is turned to cause the plate clamping device 4 to turn about the tubular pivot pin 13 for an angular interval which corresponds to $C_2$ mm, while observing the graduation ring 16. In the illustrated embodiment, the pitch of the adjustment bolt 15 is one and one half millimeters (1.5 mm), and the periphery of the graduation ring 16 is marked with thirty (30) equally spaced graduations. If $C_2$ mm is one half of a millimeter (0.5 mm), then the adjustment bolt 15 should be turned ten graduations.

Figure 4A:
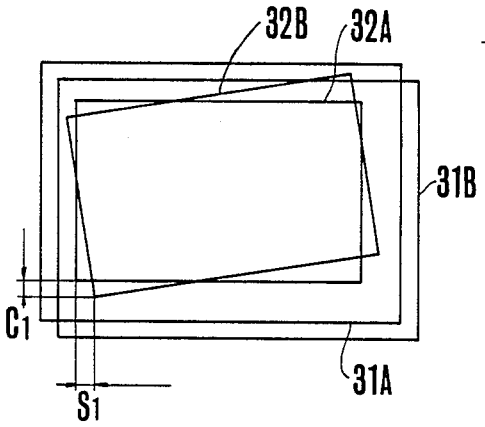
FIGS. 4(*a*) through 4(*d*) are views illustrative of register adjusting operations of the unit-to-unit register adjusting apparatus shown in FIG. 1.
Figure 4B:
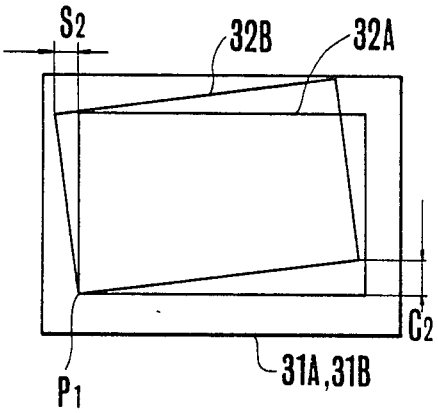
Figure 4C:
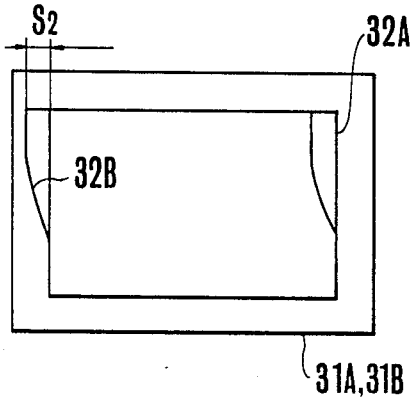
Figure 4D:
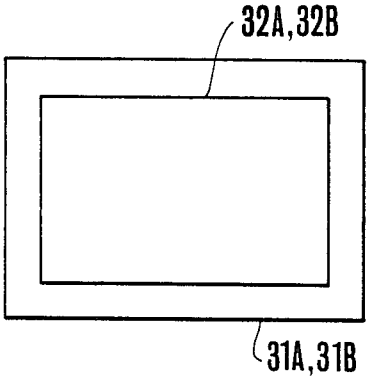

After the elimination of $C_2$ by turning the adjustment bolt 15, only the displacement $S_2$ would be present if printing were effected, as illustrated in FIG. 4*c*. However, test printing is performed at this time, and the register adjustment operation is continued. The bolt 22 is loosened and the adjustment bolt 23 is turned to displace the plate clamping device 5 axially of the plate cylinder until the graduation ring 24 is angularly moved an angular interval that corresponds to the displacement $S_2$ mm. In the illustrated embodiment, the pitch of the adjustment bolt 23 is the same as that of the adjustment bolt 15, and the graduations on the graduation ring 24 are the same as those on the graduation ring 16. Thereafter, the bolt 22 is tightened into pressed engagement with the corresponding bearer 2 to thereby fix the plate clamping device 5 in position. The adjustment bolts 21 are fastened to force the plate into close contact with the peripheral surface of the plate cylinder. Then, the adjustment bolts 9, which have remained unfastened, are tightened until their ends are brought into abutment against the wall surface of the groove 3.

When the above described second adjustment operation is over, the displacements $C_2$ and $S_2$ are all removed, as shown in FIG. 4(*d*), and the plates 32A, 32B are positioned in complete superimposition. Where the printing plate 26 is in the form of an aluminum plate, or a synthetic resin plate which is relatively soft, there is a tendency for the printing plate 26 to be elongated out of registry when the adjustment bolts 21 are excessively tightened. To cope with such a difficulty, it is preferred to use a torque wrench for tightening the adjustment bolts 21.

Although in the illustrated embodiment the plate clamping device 4 on the leading side effects circumferential register adjustment, and the plate clamping device 5 on the trailing side effects axial register adjustment, they may be reversed in function such that the plate clamping device 5 is provided with the pin tubular pivot 13, the graduated adjustment bolt 15 and other related components and features for carrying out circumferential register adjustment. While the plate clamping device 4 is equipped with the graduated adjustment bolt 23 and other related components and feature for performing axial register adjustment.

The tubular pivot pin 13 should preferably be located at one end of the plate cylinder 1 to enable the use of enlarged graduations on the graduation ring 16 of the adjustment bolt 15 and increased precision of register adjustment. However, such a pin position is not a critical requirement, and the tubular pivot pin 13 may be located centrally of the plate clamping device 4. The adjustment bolt 23 may be disposed on either axial end of the plate cylinder 1, or centrally thereof to displace the plate clamping device 5.

The present invention is not limited to the numerical examples given for pitch and number of graduations, but is applicable to other numerical selections to meet the size and other requirements of the specific printing press used.

In the illustrated embodiment, the printing plate 26 is clamped by the bases 6 and 18 and the holder plates 7 and 19, which are fastened to the bases 6 and 18 by the crank bolts 8 and 20. However, the holder plates may be mounted on the base by a quick acting clamp mechanism having eccentric cams actuatable by a lever into engagement with the holder plates to move the latter, an arrangement which has found wide use in the art.

Although a certain preferred embodiment has been shown and described in detail, it should be understood that various changes and modifications beyond those recited immediately above may be made therein without departing from the scope of the appended claims.

What is claimed as novel is as follows:

1. A unit-to-unit register adjusting apparatus for use in a sheet-fed rotary printing press having a first and a second support frame, said unit-to-unit register adjusting apparatus comprising:

a plate cylinder for supporting a plate thereon rotatably supported in said first and second support frames;

a circumferential register adjusting mechanism mounted on said first support frame for adjustably displacing said plate cylinder in the circumferential direction thereof;

a lateral register adjusting mechanism mounted on said second support frame for adjustably displacing said plate cylinder in the axial direction thereof;

an axial groove comprising a side and a bottom in an outer circumferential surface of said plate cylinder;

a pair of first and second plate clamping devices mounted in said axial groove and extending axially of said plate cylinder for clamping said plate on said plate cylinder;

a support pivot upstanding from said bottom of said axial groove and engaged with a first end of said first plate clamping device angularly moving a second end of said first plate clamping device circumferentially of said plate cylinder about said support pivot;

a first threaded member threaded on said first plate clamping device, in a location remote from said support pivot, for engaging said side of said axial groove and angularly moving said second end of said first plate clamping device circumferentially with respect to said cylinder plate;

a second threaded member threaded on said second plate clamping device for positioning said second plate clamping device axially with respect to said plate cylinder; and graduations on each of said first and second threaded members for indicating an angular position thereof.

2. The unit-to-unit register adjusting apparatus of claim 1, including a pair of bearers mounted on ends of said plate cylinder, and a third threaded member mounted threadedly rotatably on said second plate clamping device, said second and third threaded members being disposed at opposite ends of said second plate clamping device and acting against said pair of bearers to support said second plate clamping device on said plate cylinder.

3. A unit-to-unit register adjusting apparatus for use in conjunction with a printing plate, having a first and a second end, in a sheet-fed rotary printing press, said unit-to-unit register adjusting apparatus comprising:

a plate cylinder for supporting said printing plate thereon, said plate cylinder being rotatably mounted to said printing press between a first and a second support frame;

a circumferential register adjusting mechanism threadably mounted on said first support frame for adjustably displacing said plate cylinder in the circumferential direction thereof;

a lateral register adjusting mechanism threadably mounted on said second support frame for adjustably displacing said plate cylinder in the axial direction thereof;

an axial groove in an outer cylindrical surface of said plate cylinder, said axial groove having one radial wall, an opposite radial wall, a first and a second end wall, and a floor;

a first plate clamping means mounted in said axial groove adjacent said one radial wall, said first plate clamping means being selectively engageable with said first end of said printing plate for clamping said first end of said printing plate to said plate cylinder;

support pivot means upstanding from said floor proximate said first end wall pivotally supporting said first plate clamping means to said plate cylinder, such that said first plate clamping means is pivotable circumferentially therearound;

a pivotal adjusting mechanism for adjustably displacing said first end of said printing plate about said support pivot means in a pivotal circumferential direction relative to said plate cylinder;

a second plate clamping means mounted in said axial groove adjacent said opposite radial wall, said second plate clamping means being selectively engageable with said second end of said printing plate for clamping said second end of said printing plate to said plate cylinder; and an axial adjusting mechanism for adjustably displacing said second plate clamping means axially within said axial groove and for adjustably displacing said second end of said printing plate relative to said plate cylinder.

4. The unit-to-unit register adjusting apparatus of claim 3 wherein said first plate clamping means comprises an elongated member having a first end and a second end and extending axially along said axial groove, and wherein said support means pivotally supporting said first plate clamping means is disposed adjacent said first end of said elongated member and said pivotal adjusting mechanism comprises a first threaded member threadably mounted to said elongated member adjacent said other end and extending therefrom towards said one radial wall.

5. The unit-to-unit register adjusting apparatus of claim 4 wherein said first threaded member further comprises graduations equally spaced about the periphery thereof for indicating the angular position thereof relative to said first plate clamping means.

6. The unit-to-unit register adjusting apparatus of claim 3 wherein said axial adjusting mechanism comprises a second threaded member mounted threadably to said second plate clamping means and extending axially therefrom for abutment with a first portion of said plate cylinder such that rotation of said second threaded member permits axial positioning of said second plate clamping means.

7. The unit-to-unit register adjusting apparatus of claim 6 wherein said second threaded member further comprises graduations equally spaced about the periphery thereof for indicating the angular position thereof relative to said second plate clamping means.

8. A method of positionally adjusting one printing plate mounted to a plate cylinder in a printing press such as to register with an other printing plate in said printing press, said method comprising the steps of:

separately adjusting the circumferential position of said plate cylinder relative to said printing press to bring at least one preselected location on said plate cylinder into the circumferential position required for registry with said other printing plate;

separately adjusting the lateral position of said plate cylinder relative to said printing press to bring said at least one preselected location on said plate cylinder into lateral position required for registry with said other printing plate; and separately adjusting the angualr position of said one printing plate relative to said plate cylinder by pivoting said one printing plate about said at least one preselected location until a second preselected location of said one printing plate is in registry with said other printing plate.

9. The method of claim 8 further comprising, preceding said separately adjusting steps, the steps of:

interconnecting one end of said one printing plate with a first plate clamping means pivotally interconnected with said plate cylinder such as to pivot about at least one preselected location; and interconnecting an other end of said one printing plate opposite said one end with a second plate clamping means interconnected with said plate cylinder, said one printing plate being wound partially around said plate cylinder; such that said step of separately adjusting the position of said one printing plate relative to said plate cylinder comprises adjusting the angular position of said first plate clamping means relative to said plate cylinder.

10. The method of claim 9 further comprising, after said adjusting steps, the step of:

separately adjusting the axial position of said second plate clamping means relative to said plate cylinder to adjust said other end of said one printing plate relative to said one end to bring said other end into registry with said other printing plate.

11. The method of claim 9 further comprising after said step of interconnecting said other end of said one printing plate with said second plate clamping means and before said adjusting steps, the step of:

printing a sample item using said printing press to determine the amount of adjustment of said circumferential position, said lateral position, said axial position, and said angular position required in each of said adjusting steps.

12. A unit-to-unit register adjusting apparatus for use in a sheet-fed rotary printing press having a first and a second support frame, for adjusting misregistrations of a first image produced by a first plate relative to a second image produced by a second plate, each of said first and second plates having a leading edge and a trailing edge, each of said leading and trailing edges having a first and second corner location proximate a first and a second corner respectively, said first corner location of one of said leading and trailing edges having an adjustable first corner circumferential misregistration and an adjustable first corner axial misregistration and said second corner location of said one of said leading and trailing edges having an adjustable second corner circumferential misregistration and an adjustable second corner axial misregistration;

a plate cylinder for supporting said first plate rotatably supported by and between said first and second support frames, said plate cylinder having an axial groove in an outer circumferential surface thereof comprising a side wall, an end wall, and a bottom surface;

a first and a second plate clamping device each having a first and a second end mounted in said axial groove for respectively clamping said one on said leading and trailing edges and the other of said leading and trailing edges;

a circumferential register adjusting mechanism threaded on said first support frame and coupled to said plate cylinder for adjustably rotating said plate cylinder to effect a circumferential cylinder adjustment substantially eliminating said adjustable first corner circumferential misregistration;

a lateral register adjusting mechanism threaded on said second support frame and coupled to said plate cylinder for adjustably translating said plate cylinder in the axial direction thereof to effect an axial cylinder adjustment substantially eliminating said adjustable first corner axial misregistration;

a support pivot upstanding from said bottom surface of said axial groove for pivotably supporting said first plate clamping device at said first end thereof to allow circumferential movement thereabout of said second end thereof relative to said side wall;

a first threaded member threaded on said first plate clamping device proximate said second end thereof and engaging said side wall of said axial groove for circumferentially adjusting said second end to effect a circumferentially plate adjustment relative to said side wall substantially eliminating said adjustable second corner circumferential misregistration; and a second threaded member threaded on one of said first and second ends of said second plate clamping device for adjusting the axial position of said second plate clamping device to effect an axial plate adjustment relative to said end wall to eliminate at least one of said adjustable first and second axial misregistrations of the other of said leading and trailing edges.

13. A unit-to-unit register adjusting apparatus in accordance with claim 12, wherein each of said circumferential cylinder adjustment, axial cylinder adjustment, circumferential plate adjustment, and axial plate adjustment is a separate measured adjustment determined by a separate numerical measurement of each respective misregistration.

14. A unit-to-unit register adjusting apparatus in accordance with claim 13, wherein each of said circumferential register adjusting mechanism, said lateral register adjusting mechanism, said first threaded member, and said second threaded member comprise an annular periphery having graduations equally spaced thereabout, the space between successive graduations representing a predetermined misregistration adjustment for allowing said separate measured misregistration adjustment in accordance with each said separate numerical measured misregistration.

* * * * *

UNITED STATES PATENT AND TRADEMARK OFFICE

CERTIFICATE OF CORRECTION

PATENT NO. : 4,759,287

DATED : July 26, 1988

INVENTOR(S) : Fumio Shizuya

It is certified that error appears in the above-identified patent and that said Letters Patent is hereby corrected as shown below:

Column 2, line 2, delete "differ dependent" and insert ---- differ, depending ----.

Column 2, line 15, delete "unti" and insert ---- unit ----.

Column 3, line 7, after "shows" insert ---- a ----.

Column 3, line 9, delete "100 101" and insert ---- 100 and 101 ----.

Column 3, line 26, delete "herical" and insert ---- helical ----.

Column 3, line 30, delete "top position" and insert ---- bottom portion ----.

Column 3, line 50, delete "is".

Column 3, line 53, delete "porition" and insert ---- portion ----.

Column 3, line 54, delete "member" second occurrence.

Column 3, line 67, before "groove" insert ---- the ----.

UNITED STATES PATENT AND TRADEMARK OFFICE

CERTIFICATE OF CORRECTION

PATENT NO. : 4,759,287

DATED : July 26, 1988

INVENTOR(S) : Fumio Shizuya

It is certified that error appears in the above-identified patent and that said Letters Patent is hereby corrected as shown below:

Column 3, line 68, delete "slide" and insert ---- side ----.

Column 4, line 11, delete "3" and insert ---- 3. ----.

Column 4, line 13, delete "are 6 and" and insert ---- 6 and are ----.

Column 4, line 15, delete "thereo" and insert ---- thereto ----.

Column 5, line 18, delete "4" and insert ---- 4. ----.

Column 5, line 39, delete "or trailing other" and insert ---- other or trailing ----.

Column 5, line 44, delete "intimate".

Column 5, line 48, delete "and 2".

Column 5, line 57, delete "side 45" and insert ---- side ----.

Same line, after "trailing side" insert ---- 45 ----.

UNITED STATES PATENT AND TRADEMARK OFFICE

CERTIFICATE OF CORRECTION

PATENT NO. : 4,759,287

DATED : July 26, 1988

INVENTOR(S) : Fumio Shizuya

It is certified that error appears in the above-identified patent and that said Letters Patent is hereby corrected as shown below:

Column 6, line 31, before "test" insert ---- no ----.

Column 6, line 54, delete "plate" and insert ---- plate, ----.

Column 7, line 3, delete "feature" and insert ---- features ----.

In the Claims

Column 10, line 27, delete "on" and insert ---- of ----.

Column 10, line 52, delete "circumferentially" and insert ---- circumferential ----.

Signed and Sealed this

Fourteenth Day of March, 1989

*Attest:*

*Attesting Officer*

DONALD J. QUIGG

*Commissioner of Patents and Trademarks*